United States Patent [19]

Wright et al.

[11] Patent Number: 4,532,018

[45] Date of Patent: Jul. 30, 1985

[54] CHLOR-ALKALI CELL CONTROL SYSTEM BASED ON MASS FLOW ANALYSIS

[75] Inventors: David B. Wright; Richard W. Ralston, Jr.; James M. Ford, all of Cleveland, Tenn.

[73] Assignee: Olin Corporation, Cheshire, Conn.

[21] Appl. No.: 529,309

[22] Filed: Sep. 6, 1983

[51] Int. Cl.[3] ..... C25B 15/02; C25B 1/26

[52] U.S. Cl. ..... 204/98; 204/128

[58] Field of Search ..... 204/98, 128; 369/500

[56] References Cited

U.S. PATENT DOCUMENTS

| | | | |
|---|---|---|---|
| 3,616,328 | 10/1971 | Currey et al. | 204/98 |
| 3,745,101 | 7/1973 | Currey et al. | 204/98 |
| 3,773,634 | 11/1973 | Stacey et al. | 204/98 |
| 3,800,288 | 3/1974 | Russell et al. | 340/172.5 |
| 3,948,737 | 4/1976 | Cook, Jr. et al. | 204/98 |
| 4,056,448 | 11/1977 | Babinsky et al. | 204/98 |
| 4,118,789 | 10/1978 | Casto et al. | 364/900 |
| 4,212,721 | 7/1980 | Bergner et al. | 204/219 |
| 4,285,786 | 8/1981 | Larson | 204/98 |
| 4,328,549 | 5/1982 | Avery | 364/469 |

FOREIGN PATENT DOCUMENTS

| | | | |
|---|---|---|---|
| 0063737 | 6/1975 | Australia | 204/98 |
| 1051597 | 12/1966 | United Kingdom | 204/98 |
| 0715648 | 2/1980 | U.S.S.R. | 204/98 |

*Primary Examiner*—Winston A. Douglas
*Assistant Examiner*—Terry Chapman
*Attorney, Agent, or Firm*—Ralph D'Alessandro; Donald F. Clements; Thomas P. O'Day

[57] ABSTRACT

Method and means for automatically controlling chlor-alkali cells are described. Control is exercised on the basis of a mass flow analysis, starting from a target caustic concentration for the catholyte output, to establish individual set points for optimum cell system operating conditions so as to achieve said target output value. Such control is accomplished by a central automatic control unit which is adapted to monitor the operation of the cell and its associated brine and caustic output subsystems and to institute appropriate corrective actions whenever a tolerance band around one or more of said set points is exceeded.

The control unit is further adapted to provide daily and weekly operating summaries and to store said summaries for trends analyses to establish the scope and significance of any long-term degradative processes which might be occurring.

8 Claims, 6 Drawing Figures

CHLOR-ALKALI CELL CONTROL SYSTEM BASED ON MASS FLOW ANALYSIS

BACKGROUND OF THE INVENTION

This invention relates to a method and means for automatically controlling continuously operating chemical reactors and more particularly for controlling and improving the efficiency of membrane-type chlor-alkali cells.

In energy intensive processes, such as the electrolytic production of caustic soda solution and chlorine and hydrogen gases in membrane chlor-alkali cells, it is critical that overall operating efficiency be continually improved if a commercially competitive position is to be maintained. To do this, there has been a major effort to design and produce new, improved cell structures, dimensionally stable anodes, catalytic low overvoltage cathodes and high performance membranes, all of which act to lower power consumption. However, unless careful control is exerted over all aspects of the operation of such cells, the cost benefits obtained by such improvements can quickly be lost.

It is known in the art that the overall efficiency of a membrane-type chlor-alkali cell, as measured by the number of kilowatt hours required per unit of caustic produced, is a complex resultant of the interaction of a number of factors. These include, among other things, the basic design of the cell, the nature and structure of the anodes and cathodes used, the water and cation transport characteristics of the membrane, the concentration, pH, temperature and flow rate, or residence time, of the anolyte brine and catholyte caustic solutions within the cell and the cell current and voltage. While a number of these factors are essentially fixed once the cell is assembled and placed into operation, others, primarily related to the electrical and fluid-flow aspects, are capable of considerable and sometimes unpredictable changes during cell operation. Whenever such changes occur, it is usually necessary to correct them as quickly as possible if the system is to be restored to the level of efficiency previously obtained with minimum cost penalties.

While past experience often provides a guide as to what action, and how much of it, should be taken, the operating characteristics of a modern large multicell system are such that either the cause or the effects of an "upset" must usually be fairly massive before it is detected. Consequently, whatever changes are applied usually take fairly substantially periods of time before they are fully effective. Thus, it is difficult, if not impossible, for an operator to detect such a problem, analyze its significance and then interact with the system in a manner most likely to correct the problem in the shortest possible time. Moreover, several attempts may be required before full system efficiency is recovered. This is especially true in plants wherein a large number of cells are interconnected to increase product output. Further, even without an operational problem, the overall complexity of such a system tends to make it quite difficult for human operators to determine if both the individual units and the total system are all operating at maximum efficiency at any precise time. This is particularly true, where whatever changes are occurring, are the result of a slow, continuous degradation of one or more of the system components.

OBJECTS OF THE INVENTION

It is the principal object of this invention to provide a high speed automatic control system for providing optimized set points for process stream flow and temperature control in a membrane-type chlor-alkali electrolytic cell and maintaining the operation of said cell within predetermined tolerance ranges around said set points.

It is a further object of this invention to provide a high-speed automatic control system wherein said optimized set points for flow and temperature control are established by means of a mass balance.

It is an additional object of this invention to provide a high-speed automatic control system wherein a plurality of sensors are monitored to detect unacceptable variations from the operating conditions established by said set points and to institute corrective action to reinstate said optimized operating conditions.

It is yet a further object of this invention to provide a high-speed automatic control system whereby operative commands may be entered from a console terminal.

These and other objects of this invention will become apparent from the following description and the appended claims.

BRIEF DESCRIPTION OF THE INVENTION

The above objects are achieved by an apparatus and a method for controlling the operation of a chlor-alkali cell system comprised of an anolyte compartment having an anode therein and a catholyte compartment having a cathode therein, said compartments being sealingly separated by a permselective membrane mounted therebetween, said cell receiving process streams comprised of an alkali metal halogen salt brine in said anolyte compartment and water in said catholyte compartment, said cell acting under the stimulus of an electric current passing from said anode to said cathode to cause positive ions to pass through said membrane to form a caustic solution and hydrogen gas in said catholyte compartment and depleted brine and free halogen in said anolyte compartment as product streams eminating therefrom, said control method comprising:

a. periodically acquiring in a central automatic control unit a first series of electric signals from a plurality of sensors which are proportional to parameters comprising temperatures, concentrations and flows of said process and product streams;

b. comparing said first series of electric signals in said central automatic control unit with a predetermined tolerance band around a target value established for each of said signals;

c. where one or more of said first series of electric signals exceeds its tolerance band, calculating a second series of electric signals in said central automatic control unit and returning said second series of signals to said controllers; and d. adjusting said parameters of said process and product streams until said first series of electric signals are all within their tolerance bands.

DETAILED DESCRIPTION OF THE INVENTION

1. Definitions

The term "mass" is employed in the description and claims to include any organic material, inorganic material, or mixtures thereof.

The term "conduit" is employed throughout the description and claims to include any device which transports, houses, contains, directs, or diverts mass. The conduit may be totally enclosed, partially open, or perforated. Examples of conduit include pipe, headers, canals, tubing, process lines, and the like.

The term "automatic control unit" is employed throughout the description and claims to include minicomputers, microcomputers, microprocessors, digital computers, transistor circuitry, vacuum tube circuitry, analog circuits, and the like. The term "control device" is employed throughout the description and claims to include motor speed control devices, valve positioners, actuators, and the like.

The term "power supply" is employed throughout the description and claims to include AC and DC electricity power, vacuum, pressure (pneumatic power), and the like.

The term "signal" is employed throughout the description and claims to include outputs based on electrical signals, pressure signals, and the like.

The term "sensor" is employed throughout the description and claims to include transducers and other devices adapted to respond to the pressure, temperature, density or other measurable parameters of a process component or stream and produce a specific signal representative of said parameter.

The term "tolerance band" is employed throughout the description and claims to define a range of acceptable values around a control set point for a given measurable process parameter.

The term "potential" is employed throughout the description and claims to include an AC or DC electrical voltage or pneumatic fluid or gas pressure.

2. Control System Organization

Figure 1:
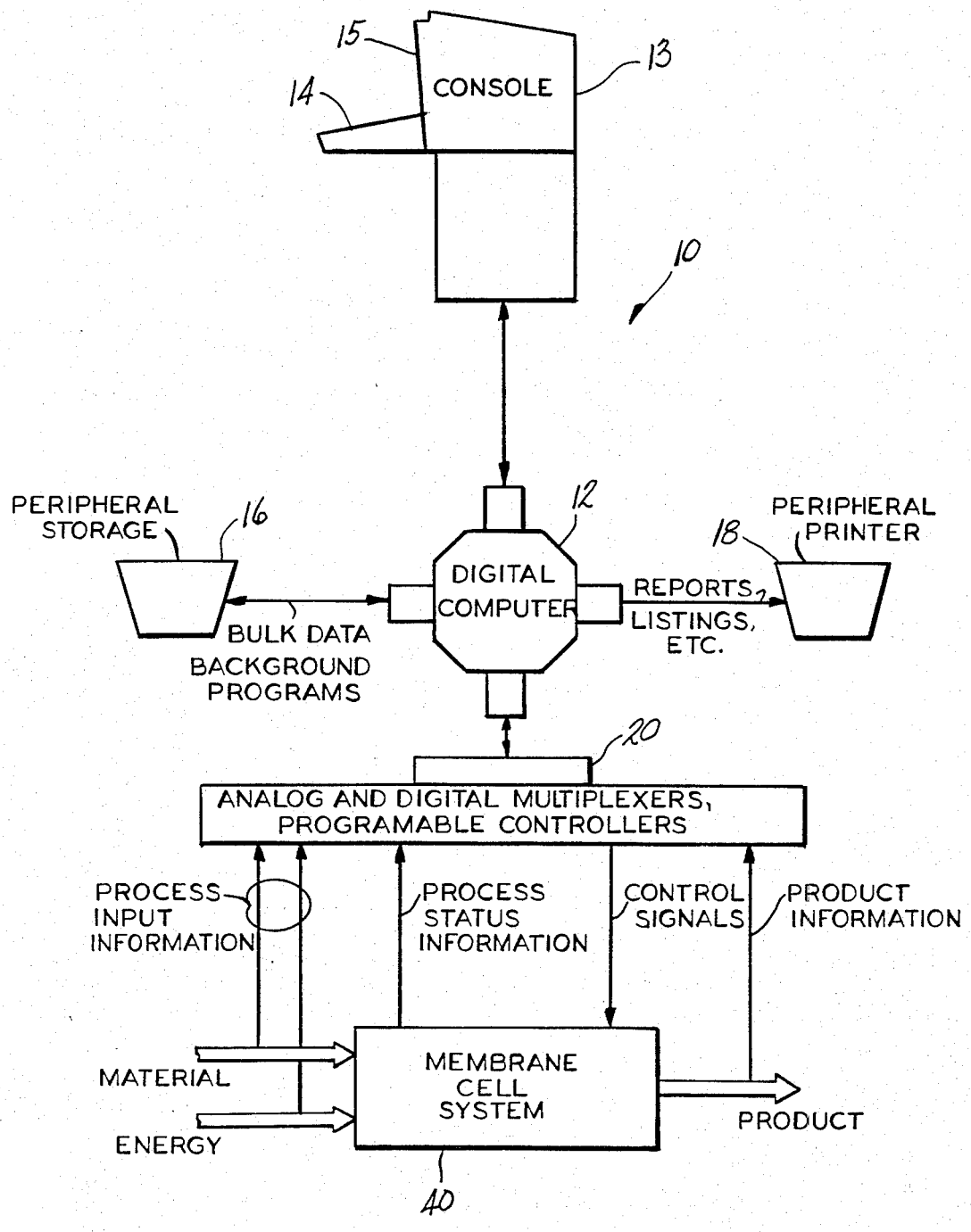
FIG. 1 is a generalized graphic display showing basic component relationships in the control system of the present invention.

FIG. 1 is a generalized graphic display showing a typical organization of the various major components of a control system that may be used in one embodiment of the present invention. Central to control system 10 is automatic control unit (ACU) 12. This is a digital computer which is adapted to manage the operation of the field instrumentation, perform all necessary operations to tabulate and present the results. Associated with ACU 12 in this respect is console station 13. This is equipped with a keyboard 14 and visual display 15, most usually a cathode ray tube (CRT). Also associated with control system 10 are peripheral storage system 16, which stores both operational data and background programs used by ACU 12 in the performance of its tasks and peripheral printer 18, which provides hard copy output of records, program listings, daily and weekly summaries, and other material as needed. In such a configuration, control system 10 readily permits the system operators to both transmit information to ACU 12 and to receive back working data, daily, weekly and monthly reports, alarm signals and other information.

Contact with the cell system is maintained through distributed control subsystem (DCS) 20. This comprises a network of individual bidirectional analog and digital multiplexers and programmable controllers, each adapted to receive process input information (brine concentration, temperature, pH, and the like), process status information (cell voltage and cell current) and product information (caustic concentration and temperature, water content of the hydrogen stream, and the like). DCS 20 is further adapted to receive control signals such as the flow rate and temperature regulator set points from ACU 12 and to translate and transmit these to individual process control devices such as the flow controllers and heaters in the brine and water conduits in a membrane cell.

As set up in the embodiment of FIG. 1, interconnection of the various sensor components with ACU 12 is maintained through conventional data transmission lines. However, it is found that the individual units comprising DCS 12 are not always compatible, in terms of intefacial communications requirements, with ACU 12 and that, when this happens, one or more intermodal adaptive techniques must be used. Such techniques are well known in the art. Data transmission rates depend on the individual units used for ACU 12 and DCS 20, with hardware adaptable to meet particular needs being widely available.

Membrane cell 40 comprises separate anolyte and catholyte compartments, which are separated by a permselective membrane, and various inlet and product outlet conduits. The individual sensors in DCS 20 are applied both to the membrane cell proper and the various inlet and outlet process stream conduits associated therewith. While the following discussion is in terms of controlling a single cell, it should be understood most commercial cell installations contain a plurality of such cells and that the method of the present invention is readily adaptable to control all the cells forming such a plurality, both collectively and individually.

3. Cell System Organization

Figure 2:
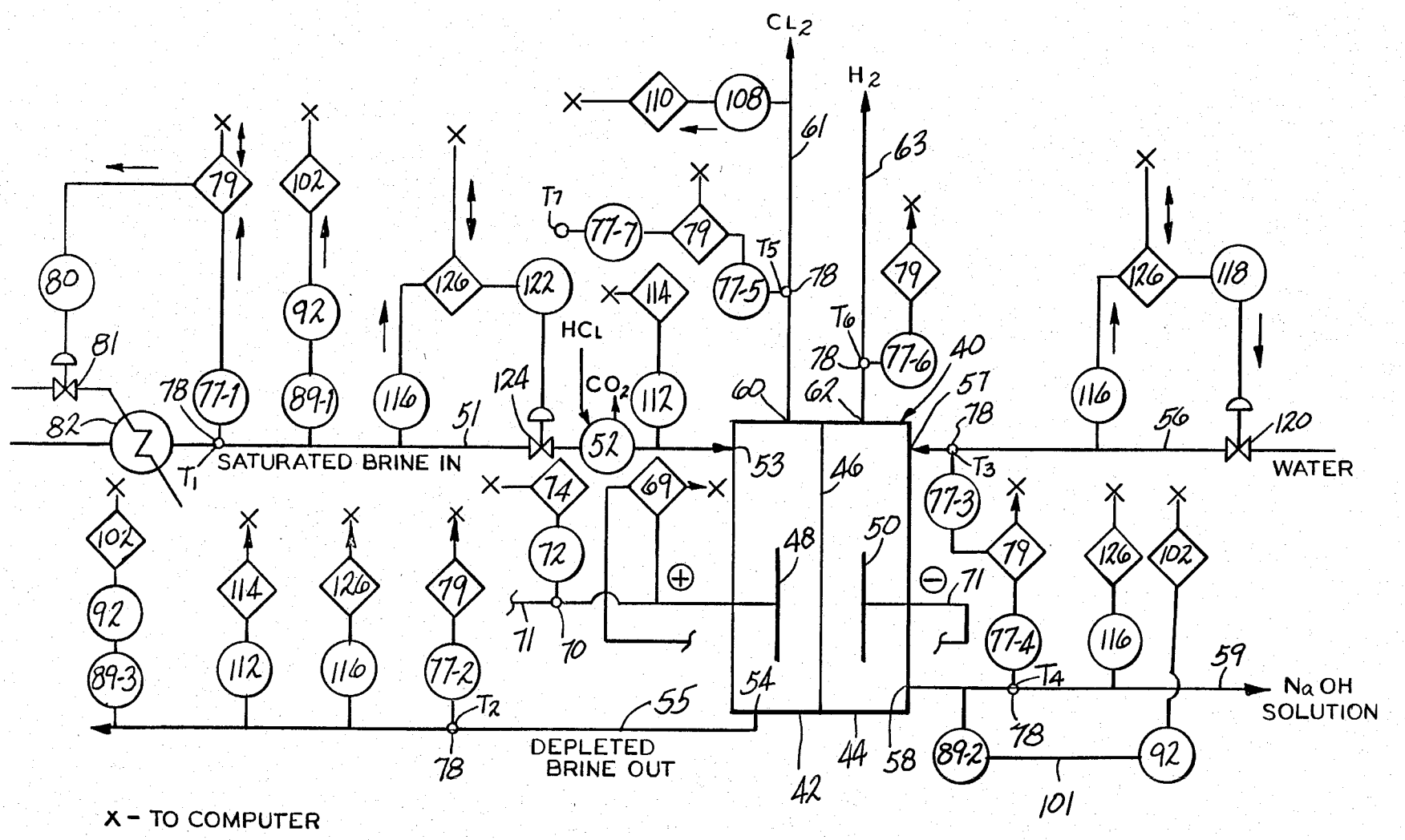
FIG. 2 is a schematic layout of the control system of the present invention.

FIG. 2 illustrates schematically the application of control system 10 to an electrolytic chlor-alkali cell.

Shown is an exemplary chlor-alkali cell 40 having an anolyte compartment 42 and a catholyte compartment 44, said compartments being sealingly separated by a permselective membrane 46 mounted therebetween. Power to the cell, delivered from an external DC power supply (not shown), passes from anode 48 in anolyte compartment 42 to cathode 50 in catholyte compartment 44 through membrane 46. The choice of electrodes and membranes for this system is not critical. A large number and variety of these are available, with economic and design considerations for each particular cell installation usually dictating which particular ones are chosen.

In the operation of the cell, a purified alkali metal halide brine, usually, but not necessarily, comprised of sodium chloride is circulated through brine conduit 51, brine head tank 52 and brine inlet 53 into anolyte compartment 42. In normal practice, the incoming brine is essentially saturated (about 300 to about 315 grams per liter when sodium chloride is used) both to minimize the size of the brine treatment facility and to maximize the efficiency of power transfer through the cell. For each pass of the brine through the cell system, a discrete amount of the salt must be removed or "depleted" in order to achieve the target production rate. In most modern cells, NaCl concentration in the discharged anolyte brine ranges from about 200 to about 260 grams per liter, the actual depletion level selected being a practical balance of economic and electrical considerations. This level of depletion is achieved by adjusting the brine flow rate to establish a specific "residence time" within the cell during which the salt content of the brine reaches the selected value range.

The depleted anolyte solution which in addition to unused salt now contains dissolved chlorine gas and hypochlorite and chlorate ions at a pH of between about 3 and about 5 is discharged through anolyte brine outlet 54 into depleted brine conduit 55 from which it is circulated through dechlorination, resaturation and purification operations (not shown) before being returned to the cell for reuse.

Brine pH is usually set at the system brine treatment facility to accomplish, among other things, lower residual chlorate and carbonate ion values in the treated brine before it is returned to the cells. In modern cell systems, the brine pH value can range from about 2 to about 10, with a pH of about 4 to about 9 being the most generally used. However, with some membranes, brine pH is more critical so that further adjustment for more precise setting of this factor may be required. Such adjustment is generally made by adding HCl as necessary to head tank 52. Should other brine factors, such as organic contamination, or the carbonate, chlorate, sulfate, calcium, magnesium or ferric ion contents need to be monitored and/or controlled, such a capability can be added to the system.

Catholyte compartment 44 is initially charged with a caustic solution usually having an NaOH concentration in the range of between about 20 and about 25 percent by weight. As the electrolysis process proceeds, the caustic concentration increases to a nominal level of between about 30 and about 40 percent. Fresh water is introduced into catholyte compartment 44 through water conduit 56 and water inlet 57 at a rate sufficient to allow the desired caustic concentration to be reached in the catholyte solution in a reasonable period of time during the process of electrolysis, said solution being discharged through caustic outlet 58 and caustic conduit 59 for subsequent recovery.

Chlorine, generated at the anode, is removed through chlorine outlet 60 and conduit 61 while hydrogen produced at the cathode is discharged through hydrogen outlet 62 and conduit 63.

4. Mass Flow Determination

In the present invention, basic control is exercised by performing repetitive mass balance calculations. This can be based on any factor which appears as both an input and an output of the system such as, in the case of a salt based chlor-alkali cell, water or sodium ions. In one embodiment of the present invention, both catholyte and anolyte flows are used.

Water mass balance, used as the basis for control of the catholyte portion by control system 10, and in its simplest expression, is based upon the equation:

$$W_{in} = W_{caustic} + W_{H2} - W_{membrane} \quad (1)$$

where $W_{in}$ is a value signal representative of a mass flow rate of a water input process stream, said stream acting to provide both a solvent for the caustic soda formed, a source of hydrogen ions for the electrolytic process and makeup for any other operational losses occurring;

$W_{caustic}$ is a value representative of a target product set point for output water loss, said loss being the total of the concentration of water in the alkali metal caustic product output stream, the flow rate of said output stream and the water lost at the cathode by the electrolytic reaction forming free hydrogen gas and hydroxyl ions in said catholyte compartment;

$W_{H2}$ is a value representative of the mass of water leaving said catholyte compartment in said hydrogen product stream, said mass being the product of the humidity and flow rate of said hydrogen product stream; and $W_{membrane}$ is a value representative of the mass of water passing from said anolyte compartment to said catholyte compartment during electrolysis as determined by water transport properties of said membrane, said mass being a composite function of anolyte brine concentration, cell current and cell temperature.

In this expression, $W_{in}$ is not just equal to the water discharged with the caustic solution and lost with the hydrogen stream less the value of $W_{membrane}$. It also must include makeup to supply the one mole of water which is required for each mole of caustic formed as shown by the equation:

$$2(H^+ + OH^-) + 2Na^+ \xrightarrow{2e} 2(Na^+ + OH^-) + H_2 \uparrow \quad (2)$$

Furthermore, it is found that each of the other factors is also a function of several system parameters. For example, the starting point for such control, $W_{caustic}$, is a function of both the concentration of water in the catholyte solution and the rate at which said solution is removed from the cell, such factors being a function of both the internal cell design and external economic considerations.

$W_{H2}$ is a function of the cell current which establishes the amount and rate at which hydrogen gas is formed during electrolysis and catholyte temperature which determines the humidity of the gas stream. At the nominal operating temperature of the cell, the high vapor pressure of water will provide a significant partial pressure in the existing gas stream. While the rapid drop in gas temperature as it leaves the immediate vicinity of the cell causes some of this moisture to condense out and return to the system, most of it is lost.

Consequently, while only an approximate measure of the water lost in the hydrogen stream is possible, equilibrium conditions will tend to keep this loss, whatever its value, reasonably constant. For purposes of calculation, the water loss in the hydrogen stream is set at 100 percent of the total amount originally carried out. Any system modifications necessitated by over-estimating the true value are taken care of by small adjustments to the input water flow rate as necessary to keep the output caustic concentration within the proper limits. The constant, high speed rate at which ACU 12 operates make such adjustments fairly simple.

$W_{membrane}$ is a function of basic membrane water permeability. This, in turn, is affected by cell temperature, the voltage drop across the cell, the cell current, membrane age and electrolyte concentrations. The mechanism for such transport is quite complex but is felt to be a combination of osmotic and electrophoresis effects which add to the water of hydration normally associated with the sodium ions passing therethrough. Where precision is necessary, $W_{membrane}$ can be determined experimentally with a procedure and apparatus such as those described by Yeager and Malinsky in "Sodium Ion Diffusion in Perfluorinated Ionomer Membranes" which appeared in The Proceedings of ACS Syposium on Membranes and Electronic Conducting Polymers, Case Western Reserve University, Cleveland, Ohio, May 17, 1982. Such an apparatus produces data leading to calculated "response surfaces" for both cation and water transfer in the membrane. The data representing these surfaces, once determined, can be incorporated into the data banks of peripheral storage system 16 for subsequent use in calculating an overall water mass balance.

However, these data are only good for the membrane being used and may not accurately predict transport property changes due to membrane aging or degradative changes resulting from problems such as plugging by impurities in the brine. Therefore, considering the inherent uncertainty in the value of $W_{H2}$, a highly detailed representation of membrane characteristics also may not be necessary. In many cases, a close approximation of these characteristics based on prior operational experience may be used. In the operation of the control system of this invention, it has been shown that by so doing, reasonably close operating values can be provided which, with the continuous monitoring and adjustment capabilities of ACU 12, can be quickly adjusted to achieve substantially optimized operating conditions at all times.

In a similar manner, the water mass balance used as the basis for control of the anolyte portion by control system 10 is based upon the equation:

$$W_{brine} = W_{anolyte} + W_{CL2} + W'_{membrane} \quad (3)$$

where $W_{brine}$ is a value representative of the total water mass flow rate in the brine input process stream, said stream acting to provide a source of alkali metal for the caustic soda formed in said catholyte compartment and a source of halide ions for the electrolytic process;

$W_{anolyte}$ is a value representative of the anolyte brine output water loss, said loss being the product of the concentration of water in the anolyte brine output stream and the flow rate of said output stream; $W_{Cl2}$ is a value representative of the mass of water leaving said anolyte compartment in said halogen output stream, said mass being the product of the concentration of water in said halogen product stream and its flow rate; and $W'_{membrane}$ is a value representative of the mass of water passing from said anolyte compartment to said catholyte compartment under the stimulus of said current as determined by water transport properties of said membrane, said mass being a composite function of anolyte brine concentration, caustic concentration, cell current and cell temperature. This value is substantially equal to the value of $W_{membrane}$ as used in catholyte portion control.

As with catholyte control, it is found that each of these factors is also a function of several anolyte system parameters. For example, the starting point for such control, $W_{anolyte}$, the target reconstituted brine feed rate, is a function of both the concentration of water in the anolyte solution and the rate at which said depleted brine is removed from the cell, such factors being a function of both the internal cell design and external economic considerations.

$W_{Cl2}$ is a function of the cell current which establishes the amount and rate at which halogen (usually chlorine gas) is formed during electrolysis and catholyte temperature, which determines the humidity of the gas stream. At the nominal operating temperature of the cell, the high vapor pressure of water will provide a significant partial pressure in the exiting gas stream. While the rapid drop in chlorine gas temperature as it leaves the immediate vicinity of the cell causes some of this moisture to condense out and return to the system, most of it is lost.

Consequently, while only an approximate measure of the water lost in the halogen output stream is possible, equilibrium conditions will tend to keep this loss, whatever its value, reasonably constant. For purposes of calculation, the water loss in the chlorine gas stream is estimated as being about 100 percent of the total amount originally carried out. Any system modifications necessitated by over-estimating the true value are taken care of by small adjustments to the input water flow rate as necessary to keep the output caustic concentration within the proper limits. The constant, high speed rate at which ACU 12 operates make such adjustments fairly simple.

In most commercial cell systems, there is a single source of brine for all the cells therein. In normal plant operation, the salt concentration of this brine is fixed prior being supplied to the cell line. Thus, while brine feed rate can be controlled by ACU 12, the brine salt concentration, as a practical matter, cannot.

The sodium mass balance is based on the equation:

$$S_{in} = S_{anolyte} + S_{membrane} \quad (4)$$

where $S_{in}$ is a value representative of a target product tolerance band for the mass of alkali metal ion entering in the incoming brine product stream;

$S_{anolyte}$ is a value representative of the mass of alkali metal ion leaving said anolyte compartment in said anolyte product stream; and $S_{membrane}$ is a value representative of the mass of alkali metal ion passing through said membrane so as to act as a basis for the alkali metal content of the caustic product stream from said catholyte compartment.

As with the water mass balance control scheme described hereinabove, each of these factors requires some explanation. $S_{in}$ is derived from the concentration of salt in the incoming brine, as measured by densitometer 89-1 in brine conduit 51.

$S_{anolyte}$ primarily comes from the unused salt in the anolyte brine which is discharged into depleted brine conduit 55. However, there are also percentages of hypochlorite and chlorate ions present so that a sodium analysis based on anolyte density as determined by densitometer 89-3 will not be completely accurate. Where cell operation is reasonably consistent, such inaccuracy may be compensated by a suitable correction factor. Where, however, the cell system is subject to both planned and, more particularly, unplanned fluctuations, chemical analysis may be required for improved accuracy. Facilities for so doing, both off-line and on-line, are widely available.

$S_{membrane}$ is essentially equal to the mass of sodium on the caustic solution appearing in caustic conduit 59 as measured by densitometer 89-2. As with water transport, sodium transport can be defined by an appropriate response surface so such a measurement also provides means for checking the real response with the predicted response. Where substantial differences exist, this is indicative of a membrane problem which may require corrective action.

In the process of the present invention, a sodium mass balance, when performed along with the water mass balance, can provide an important measure of brine plant consistency.

The above analysis is based on utilizing the control system of the present invention in a membrane cell, wherein inputs and outputs are largely separated. In other situations, such as in diaphragm-type chlor-alkali cells, sodium chloride appears in both the anolyte and catholyte output. While such a situation creates additional instrumentational complexity, the basic control scheme as defined herein, after suitable modifications of equations (1), (3) or (4), as applicable, would remain the same.

It should also be understood that other mass species, such as chlorine, in an electrolytic chlor-alkali or chlorate cell, can be utilized as additional bases for the control scheme of this invention. As long as the mass flows can be monitored and quantified, such use is within the ambit of the present invention.

5. Cell System Application

In the application of the control system of the present invention to a membrane cell, two modes of operation must be considered: stable and unstable. Stable operation comprises the suboperations of controlled startup, "nominal" operation, and controlled shutdown. Unstable operation comprises system upset situations such as power failures and calcium surges and the recovery operations required thereby.

In control startup operations, after the cell is initially charged with anolyte and catholyte solutions, the cell is turned "on" at relatively low values of temperature and current loading (expressed as kiloamps per square meter of electrolysis area), which are gradually increased to the normal operating levels. These increases are usually done on a programmed schedule which is normally established by previous operating experience with the particular cell and membrane combination in use. In normal practice, it takes between about 1 and about 4 hours to reach operating conditions depending on the ultimate current. Where only one cell or a total string of cells is to be started as a group, such a practice is fairly straightforward. A similar mode of operation occurs with a controlled cell shutdown wherein the current and temperature are gradually lowered.

However, where it is necessary to insert or remove a cell from an already operating group of cells, more complex adjustments to the operating mode must be made. One method and apparatus for the controlled startup and shutdown of one of a series of electrolytic cells is described by Kircher in U.S. Pat. No. 4,251,334 issued Feb. 17, 1981, which to the extent relevant is incorporated herewith.

In the embodiment depicted in FIG. 2, control system 10 is adapted to monitor 22 separate factors in and around a cell as follows:

1. cell voltage,
2. cell current,
3. inlet brine temperature*,
4. outlet anolyte temperature,
5. inlet water temperature,
6. outlet caustic temperature,
7. hydrogen gas temperature,
8. chlorine gas temperature,
9. cell body temperature,
10. brine NaCl concentration,
11. anolyte NaCl concentration,
12. caustic NaOH concentration,
13. $O_2$ concentration in $Cl_2$,
14. $N_2$ concentration in $Cl_2$,
15. $CO_2$ concentration in $Cl_2$,
16. $H_2O$ concentration in $H_2$,
17. brine pH,
18. anolyte pH,
19. brine input flow rate*,
20. anolyte output flow rate,
21. water input flow rate*,
22. caustic output flow rate, with the factors marked * being directly controlled. This list is merely illustrative and in the following sections, the discussions of particular parametric measurements or the use of particular sensing units to make such measurements are not intended to be considered as being definitive insofar as implementation of the subject invention to a particular control application is concerned.

As noted above, control system 10 operates through a plurality of individual controllers which operate around pre-established "set points", each of which may have a tolerance band as a range of acceptable values therefore, for each parameter being monitored. The procedure by which these set points are set starts with the establishment of target caustic concentration for the discharged catholyte solution. Since this factor often depends on external constraints, such as sales requirements, it may be expected to change from time to time. When this happens, the changed value is manually input from console station 14 by the system operator. In steady-state operation, this is normally the only manual operation required to implement the control process of this invention. However, as noted above, situations may develop wherein it is desirable to change anolyte concentration, cell temperature and/or brine pH. The control system of the present invention is adapted to allow such active intervention in regard to these factors when necessary.

From this, a corresponding set of specific operating set point values for process stream compositions, flow rates, system power levels and temperatures are calculated by ACU 12 utilizing nominal process status data and a set of specific algorithms stored within the data banks of peripheral storage system 16. These values are forwarded to the individual controllers and multiplexers in DCS 20 to provide any control set point adjustments needed for cell operation.

In normal operation, ACU 12 individually interrogates most multiplexers periodically, usually once every few minutes. To be sure that data are available, the multiplexers repeatedly acquire fresh information for much shorter periods of time, usually from between about 0.1 to about 20 seconds in length. Such a procedure is safe because the normal inertial effects inherent in large fluid based systems generally prevent system changes from occurring more rapidly. In other situations, as with gas chromatographic analysis of the chlorine stream, the time required to generate the data is much longer. In such cases, the sensor is adapted to assert a low priority interrupt which acts to inform ACU 12 that the data are ready. In its current configuration, ACU 12 will respond to the interrupt whenever no higher priority operation is running.

Depending on the needs of the system, the multiplexers, when interrogated, can be programmed to respond with either the last reading, an integrated value summing all readings taken since the last interrogation or a computed average of the individual readings taken over the time period for the ACU interrogation. With current instrumentation, such information can appear as analog AC or DC voltages, DC currents or pulsed digital signals. Where analog signals are received, these must be converted to digital signals for subsequent transmission to ACU 12. While this is usually done with circuitry within the multiplexer using conventional analog to digital (A/D) circuitry, many units suitable for use as an ACU also incorporate a capability to make such conversions when necessary. Pulsed signals can be handled directly usually by counting the pulses for specific periods of time. Normally, the data acquired are retained in buffer registers contained within each multiplexer and only sent to ACU 12 when the regularly scheduled request arrives.

Where an "emergency" situation, such as a power outage, occurs, it is possible for the multiplexer to invoke a high priority interrupt within ACU 12. This enables it to suspend whatever the computer is then doing to inform it that a situation has arisen requiring its immediate attention. In practical terms, this will result in an alarm signal being sounded, usually within 10 seconds of the malfunction being detected, and the immediate start of corrective action. Such rapid response is one of the inherent advantages of the high-speed digital control system of this invention.

Another type of unit available for use as a component of DCS 20 is a programmable controller. This has capabilities for analyzing the signals received to determine if the value received is within certain tolerance band limits around the set points which were originally established by ACU 12. If the value is outside of these limits, it can, when necessary, sound appropriate alarms in the control room. Where the correction of an out-of-specification value involves relatively minor system modifications such as changing the output of a system heater, it has the additional capability to institute such corrective measures without having to sound an alarm or wait for specific instructions from ACU 12.

Once the system is in more or less stable operation, the information management scheme adjusts to feed the operating data back to ACU 12 to provide continuous data on system status. As conditions change, new set points may be required and these are computed and returned to the controllers as needed. This continuous management allows the cell system to be operated smoothly and at maximum efficiency. When necessary, it also allows the transition from startup or system malfunction status to normal operating conditions to be made smoothly and quickly.

6. Cell System Control Scheme

Figure 3:
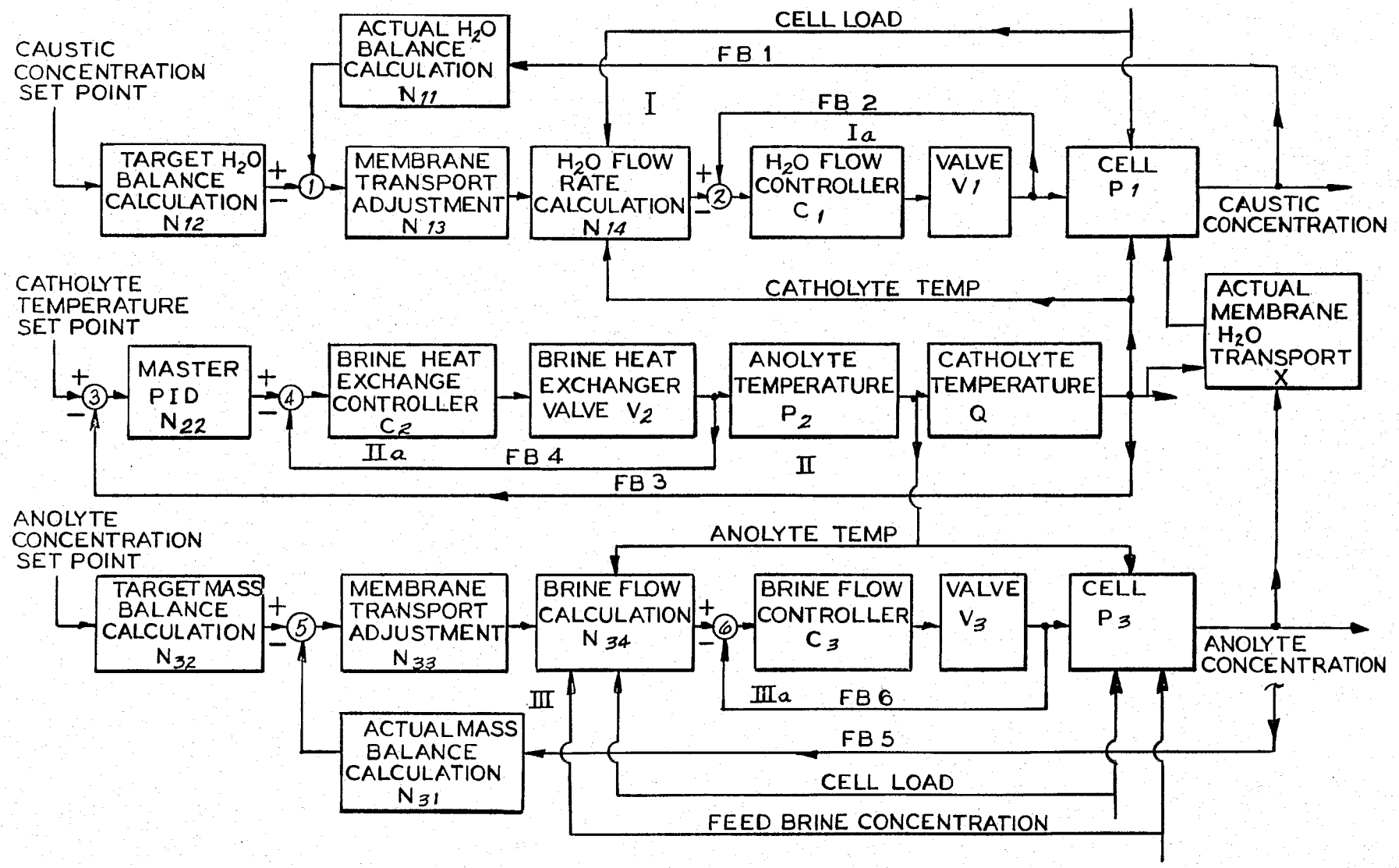
FIG. 3 is a block diagram showing the organization of the control system of the current invention.

FIG. 3 is a block diagram of a control scheme as used in one embodiment of the present invention. As shown, it is an interconnected three-loop control system which is adapted to either directly or indirectly control the parameters of anolyte composition, brine flow, brine temperature, water flow, catholyte temperature and catholyte composition. For reference purposes, the summing point, ○, and operation block, □, symbols shown are consistent with standard definitions for control system diagrams as shown in "Feedback and Control Systems" by DiStefano et al. The particular algorithms utilized for the operation blocks are listed in Table I. These algorithms are specific and are descriptive of the mass flow relationships as observed in the particular membrane chlor-alkali cell system for which they were developed. Where other operating systems are used, additional and/or modified versions of these algorithms may be required depending on the specific process and control systems to which they are applied.

Loop I of FIG. 3 is concerned with catholyte concentration control. At summing point ①, a signal representing the desired water content of the product catholyte stream as previously determined by ACU 12 through catholyte concentration set point conversion algorithm N12 is inserted. This is differentially summed with feedback signal FB1, which represents the actual water content of the product catholyte stream as measured by densitometer 89-2 in conduit 59 of FIG. 2 and converted by water balance algorithm N11. The differential or "error" signal resulting from this summation is further processed by algorithm N13, a water transport number adjustment algorithm which acts to compensate the total water flow by the value for $W_{membrane}$. As noted above, the approach used for this aspect of system control is to use a close approximation of the membrane water transport number which is based upon past experience with the membrane used. This value of $W_{membrane}$ is expressed as a transfer function which, in FIG. 3, is denoted by the term "X", the function of which is explained in connection with loop II, described hereinbelow. In [N13], this value is recomputed, based on the error differential established at summing point ① which, in turn, is downloaded to [N14] as a component for the calculation of the corrected water flow rate.

The target water flow rate, represented by the set point value is downloaded by ACU 12 for use by water flow controller 118 of FIG. 2 and shown as [C1]. This value is determined by water flow rate algorithm N14, using measured values for the cell current as measured by circuit load detector 70, catholyte temperature as measured by temperature sensor 77-4 at location T4 in caustic conduit 59 of FIG. 2 and the previously determined, corrected value of the water transport number, $W_{membrane}$.

Where the aforementioned comparison signal from [N14] at ② indicates that the catholyte concentration is within the tolerance band set around the caustic concentration set point, no corrective action need be taken. If, however, the "error" over the tolerance band is exceeded, corrective action is taken to establish a new water flow set point for the slave control loop Ia, as shown in FIG. 3.

This is done by differentially summing at ②, the adjusted water signal value from algorithm N14 with a feedback signal, FB2, around salve loop Ia which comprises paddle wheel flow monitor 116, flow controller 118, shown as [C1], and its associated and water flow control valve 120, shown as [V1]. The interaction of [N13] and [N14] continues repetitively to provide set point comparison values for summing point ② until the differential value between the actual $H_2O$ balance and the target $H_2O$ balance falls within the tolerance band. The rapid action of ACU 12 in first acquiring the necessary data and then in processing it assures that this can be done with a minimum number of cycles.

In one embodiment of this invention, the water control feedback signal, FB2, is a variable analog signal, so that while the value computed by algorithm N14 remains fixed during the nominal interval from one differential comparison at ② to the next, water flow control around slave loop Ia is continuously adjusted by water flow controller 118. This allows minor variations in flow rate to be more or less instantly corrected. It will be appreciated that digital units can accomplish the same results, and that the choice of analog or digital equipment is one of economic not technical requirements.

FB2 is a signal proportional to the measured water flow through valve 120, is also one of the inputs to [P1]. Here, it is combined with the catholyte temperature from [Q], the actual value of $W_{membrane}$ from [X] and a value for cell load to produce an output, referred as FB1 by densitometer 89-2 in caustic conduit 59. This is utilized by the water balance algorithm N11 to calculate the actual water balance.

Loop II is concerned with temperature control in and around the cell. As shown in FIG. 3, loop II is interconnected with both loop I for catholyte concentration control and loop III for anolyte concentration control. In a chlor-alkali cell system, there are generally only two main thermal sources, the heat in the incoming brine and the resistive heating across the cell. Heat is primarily carried out in both the gas and liquid product streams. In nominal operation, the heat balance is more or less fixed to provide an overall temperature of between about 85° and about 100° C. To do this, close control of the thermal aspects of cell operation is required.

In the control system of the present invention, such control starts at summing point ③ wherein the catholyte temperature target set point signal as downloaded by the operator from console station 13 is differentially summed with FB3, a feedback signal representative of the actual catholyte temperature as measured by temperature sensor 77-4 at location T4 in catholyte output 59 as shown in FIG. 2. Catholyte temperature is used as the reference because operational requirements of membranes dictate that the cathode side of the membrane be exposed to a rather narrow band of temperatures, if maximum efficiency is to be obtained and excessively rapid degradation avoided.

Since the magnitude of the IR drop across the cell and the heat of reaction are more or less fixed, brine feed temperature control is customarily used as the means of making any thermal adjustments necessary.

In control loop II, as in control loop I, the output of ③ is processed by N22, a standard Proportional Integrating Derivative (PID) algorithm, wherein ACU 12 determines if brine temperature control is needed. Where such is required, an output signal which acts to reset the set point for brine temperature is transmitted to ④ where it is differentially compared with FB4 the feedback temperature around slave loop IIa as measured by temperature sensor 77-1 at location T1 in brine conduit 51, as shown in FIG. 2. As with FB2, in control loop I, FB4 is an analog signal so that brine temperature controller 80, shown as [C2] and heating/cooling subsystem 82, shown as [V2] operate continuously to make any adjustments necessary to keep the output temperature within the tolerance band around the set point as established by ACU 12 at ④. FB4 also passes through [P2] wherein it is combined with resistive temperature generated by the IR drop across the cell, measured by temperature sensor 77-2 at location T2 in depleted brine output 55 as shown in FIG. 2.

This combined value is fed forward to algorithm N34 and [P3] where it is combined with the effects of cell loading and feed brine concentration, as measured by densitometer 89-1 in brine conduit 51 of FIG. 2 for brine flow control at ⑥.

Anolyte temperature is forwarded to [Q]. The output of [Q] aids in estimating the amount of unrecoverable water lost in the hydrogen stream as part of $W_{H2}$. In this, there is a certain noncondensible loss as determined by the ambient temperature around the cell system. The catholyte temperature establishes the partial pressure of $H_2O$ in the hydrogen, i.e. the total amount of $H_2O$ actually evaporated from the catholyte solution. In theory, at least some of this water should be condensed in the hydrogen disengager (not shown) of the cell and returned to the system. However, due to the difficulties in measuring such a quantity, it is assumed that none of it is returned. Any error in this assumption will show up as a change of product concentration which, in the control system of this invention, is corrected by a corresponding change in the flow rate of the water input process. This value of $W_{H2}$ is determined in [P1] and [N14], using algorithm 14(C).

As noted above, the value of [Q] is also a factor in determining the present value of "X", the actual membrane water transport value. While the aforementioned response surfaces can be used to more or less accurately establish the value of $W_{membrane}$ as a function of the anolyte concentration and catholyte system temperature, such values tend to become increasingly inaccurate as the membrane ages. To simplify system control, the present invention inserts a value for $W_{membrane}$ which is based on the nominal water transport properties established from prior system performance. As shown, this value is inserted into [P1] to complete the set of values (the water flow through [V1], $W_{H2}$ and $W_{membrane}$), making up the magnitude of $W_{caustic}$ which, in turn, is returned via FB1 to [N11].

Loop III is concerned with anolyte control and is similar to loop I insofar as to the basic control scheme is concerned. As shown, the anolyte concentration set point, is summed at ⑤ with an anolyte concentration feedback signal, FB5, which is generated by densitometer 89-3 and multiplexer 102 in anolyte brine conduit 55 as shown in FIG. 2 with the resultant being utilized in algorithm [N31] by ACU 12. Again, where an out-of-tolerance band condition is encountered, an error adjusted brine flow signal is generated first at [N33] and then [N34] in the same manner as used with [N13] and [N14] to produce a signal which is differentially summed at ⑥ with the true value of brine flow to adjust such flow. This is done in loop IIIa comprising FB6 around [C3] and [V3] in a manner which is similar to that used around loop Ia in loop I.

The corrected value of brine flow is further processed in [P3] to produce an overall anolyte concentration value which is returned via FB5 to [N31] as a component of the differential summation conducted with the target $H_2O$ balance as established by [N32] at summing point ⑤. This is done in the same manner as used for the water balance summation conducted at summing point ①. The values generated herein provide all the necessary data, when combined with the caustic product concentration data generated in loop I to perform a sodium mass balance as defined by equation (4) above.

TABLE I

Summary of Control Algorithms

Algorithm N11 - Actual Water Balance Calculation $$Y = \frac{60\ KA}{96.5}\ CE$$

$$N_o = (40)Y$$

$$W_{caustic} = \frac{1 - C_o}{C_o} \cdot N_o$$

Algorithm N12 - Target Water Balance Calculations - Caustic Loop $$W_{target} = \frac{1 - C_T}{C_T} \cdot N_o$$

Algorithm N13 - Transport Number Adjustment - Caustic Loop $$DTW_c = \frac{W_{caustic} - W_{target}}{(18)Y}$$

$$TW_c = TW_c + DTW_c$$

Algorithm N14 - Water Flow Calculation $$W_R = (18)Y \quad \text{(a)}$$

$$W_{membrane} = W_R \cdot TW_c \quad \text{(b)}$$

$$W_{H2} = \frac{W_R \cdot PC}{2(760 - PC)} \quad \text{(c)}$$

$$W_{in} = W_{caustic} + W_{H2} + W_R - W_{membrane}$$

Algorithm N31 - Actual Water Balance Calculation - Anolyte Loop $$W_{anolyte} = \frac{1 - A_o}{A_o} \cdot S_o$$

$$S_M = (58.5)Y$$

$$S_o = S_I - S_M$$

Algorithm N32 - Target Water Balance Calculation - Anolyte Loop $$W'_{target} = \frac{1 - A_T}{A_T} \cdot S_o$$

Algorithm 33 - Transport Number Adjustment - Anolyte Loop $$DTW_A = \frac{W_{anolyte} - W'_{target}}{W_R}$$

$$TW_A = TW_A + DTW_A$$

Algorithm N34 - Brine Flow Calculation $$W'_{membrane} = W_R \cdot TW_A$$

$$W_{Cl2} = \frac{W_R \cdot PA}{2(760 - PA)}$$

$$B_{in} = \frac{AF(S_M + W'_{membrane} + W_{Cl2}) - S_M}{AF - BF}$$

Notation:

| | | |
|---|---|---|
| (18) | = | molecular weight of $H_2O$. |
| (40) | = | molecular weight of NaOH. |
| (58.5) | = | molecular weight of NaCl. |
| AF | = | weight fraction of NaCl in anolyte. |
| $A_o$ | = | anolyte concentration. |
| $A_T$ | = | target anolyte salt concentration. |
| BF | = | weight fraction of NaCl in feed brine. |

TABLE I-continued

Summary of Control Algorithms

| | | |
|---|---|---|
| $B_{in}$ | = | brine flow input. |
| CE | = | current efficiency. |
| $C_o$ | = | actual caustic concentration. |
| $C_T$ | = | target caustic concentration. |
| $DTW_A$ | = | change in anolyte side water transport number. |
| $DTW_c$ | = | change in caustic side water transport number. |
| KA | = | cell current (load). |
| $N_o$ | = | weight of caustic exiting cell per unit time. |
| PA | = | partial pressure of water over anolyte. |
| PC | = | partial pressure of water over caustic at given temperature. |
| $S_I$ | = | weight of salt entering cell per unit time. |
| $S_M$ | = | weight of salt decomposed. |
| $S_o$ | = | weight of salt exiting cell per unit time. |
| $TW_A$ | = | anolyte side water transport number. |
| $TW_c$ | = | caustic side water transport number. |
| $W_{in}$ | = | water flow input. |
| $W_R$ | = | water consumed by reaction: |

$$2(H^+ + OH^-) + 2Na^+ \xrightarrow{2e^-} H_2\uparrow + 2(Na^+ + OH^-).$$

| | | |
|---|---|---|
| $W_{target}$ | = | target weight of water exiting in the caustic stream per unit time. |
| $W'_{target}$ | = | target weight of water exiting in the anolyte stream per unit time. |
| Y | = | number of equivalents of sodium transported across the membrane. |

7. Exemplary Procedure

In accordance with the above-described control scheme, the following is a step-by-step listing of one schedule of activities which can be applied to control a membrane chlor-alkali cell according to the present invention:

A. Catholyte Control

1. Every three minutes calculate the water through the membrane based on KA (cell current) and transport number in units of moles of water per mole of sodium.
2. Calculate the NaOH leaving the cell based on KA and a current efficiency of 95 percent.
3. Calculate the water leaving with the hydrogen based on KA and the vapor pressure of water over caustic at the target concentration ($W_{H2}$)
4. Get the target caustic concentration and calculate the water out with the caustic. ($W_{caustic}$)
5. Calculate the water input required. ($W_{in}$)
6. Calculate error. Error=required flow-actual (measured) flow.
7. Calculate the adjustment to the water flow set point required. Send signal to the slave flow controller.
8. Calculate % caustic from the latest GPL value (or reading).
9. Calculate the NaOH rate from cell current.
10. Calculate the actual water rate based on NaOH rate and concentration (%).

11. Calculate the target water rate based on target concentration.
12. Calculate the change in transport number from the previous value.
13. Adjust the transport number.

B. Anolyte Control

1. Every three minutes determine the specific gravity of the brine and calculate the fraction NaCl therein.
2. Calculate the Na through the membrane based on KA (cell current).
3. Calculate water through the membrane based on KA and the present water transport number. ($W'_{membrane}$)
4. Calculate the water out with the chlorine based on temperature, vapor pressure of water over brine at the concentration in the anolyte and chlorine rate. ($W_{Cl2}$)
5. Calculate the required brine flow based on the material balance.
   Flow=(AF*MNa−MNa+WM+AF+$W_{Cl2}$*AF)/(AF−BF) where:
   AF=fraction NaCl in anolyte (1−AF=$W_{anolyte}$);
   MNa=moles NaCl removed by electrolysis;
   WM=water through the membrane;
   $W_{Cl2}$=water out with the chlorine;
   BF=fraction with NaCl in the brine.
6. Determine the brine flow rate. ($W_{brine}$)
7. Calculate the flow error.
   Error=calculated flow-actual (measured) flow.
8. Calculate the change in flow set point required and send the signal to the slave flow controller.
9. Determine the brine concentration (in grams per liter).
10. Determine the anolyte concentration (measured or operator entered).
11. Calculate the water leaving the anolyte compartment.
    Exit NaCl=NaCl in-NaCl removed by electrolysis;
    Calculate the fraction NaCl in anolyte;
    Exit water=exit NaCl* (1-fraction NaCl/(fraction NaCl)+$W_{Cl2}$.
12. Calculate the change in transport number from the previous value.
    Delta TW=(target exit water-actual exit water)/-(water through membrane).
13. Reset the transport number.

In the procedure, as thus described, anolyte and catholyte controls are exerted more or less simultaneously. The high speed of ACU 12 makes such a practice quite easy to accomplish.

It should be understood that other schedules and a different number of operating steps may be required to meet specific operational needs within the basic operational method of this invention.

8. System Components

In applying the above-described system, the individual operating components must meet a variety of requirements in order both to acquire the required information and to function satisfactorily in the rather severe environment typical of a chlor-alkali plant.

Described below are the general constraints found to be significant in applying the control system of this invention to a chlor-alkali cell system.

In the following discussion, reference should be made to FIG. 2 for the nominal location of the specific instruments used within a cell system as described hereinbelow.

A. Power Measurement a. Voltage

The measurement of the nominally low voltage drop values (between about 2 and about 5 volts DC) occurring within a chlor-alkali cell only requires a set of leads from the positive and negative bus bars to voltage conversion multiplexer 69. This signal, after analog to digital (A/D) conversion, is sent to ACU 12 upon request. The value presented is the most recent measurement acquired. No line shielding or special instrumentation is required for this measurement except, possibly, for a low pass filter to remove any AC voltages caused by rectifiers. However, this signal can have a common mode off-set of several hundred volts from ground and from ACU 12. Some isolation method such as optical coupling is therefore required to isolate cell line potential from ACU 12.

b. Current Measurement

Figure 4:
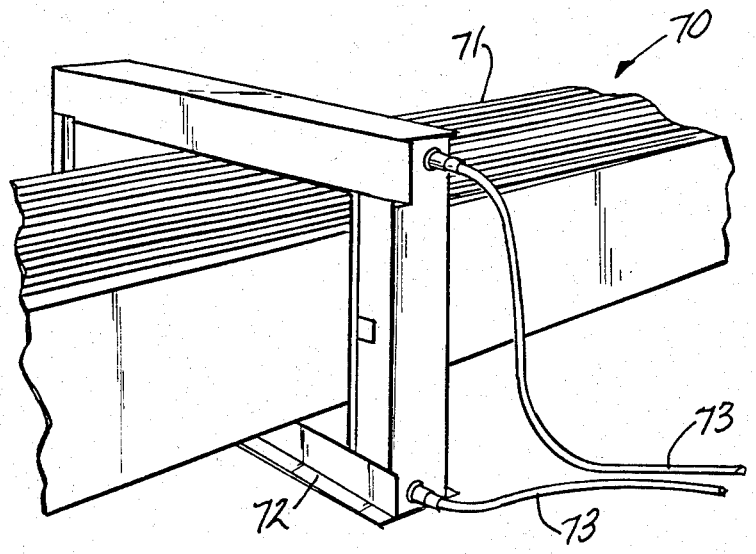
FIG. 4 is an isometric view of a current sensor as installed on a cell power bus line.

Currents of between about 2 and about 15 kiloamps per square meter of electrode surface are used in many modern membrane type cells. Current values of this magnitude cannot be measured directly and an indirect circuit load detector 70 is normally used for this purpose. One type suitable for such use is shown in FIG. 4. This utilizes the DC magnetic field which encircles the bus bars leading to the system. By encircling bus bar 71 with a yoke 72 containing opposed Hall Effect sensors 73, a steady-state null current, proportional to the strength of this field, is generated. Such sensors are quite sensitive and quickly respond to field strength variations resulting from line current flow changes as small as 1 percent. The null current generated can be converted to a low amplitude voltage by conducting it through a suitable resistor (not shown) and in the present system, signals on the order of about 1 millivolt DC/KA of current are provided.

As shown in FIG. 2, this analog millivolt signal is fed to current multiplexer 74 wherein it is treated in much the same way as the voltage signal for the cell voltage measurement. Depending on the particular system, the individual values can be reported as well as their product (in kilowatts) for power consumption analysis. With signals of this relatively low amplitude, the conduits from the measurement sensors should be shielded so that voltages from stray fields within the system are not picked up and read along with the desired signal.

Current measurement is utilized for purposes other than simple power consumption measurement. Thus, in the present system, it provides a theoretical measure for the quantities of chlorine and hydrogen produced with these two products together requiring about 96,500 coulombs (ampere-sec.)/(gram mole, under ideal circumstances. The extent to which the actual value obtained differs from this ideal value is a measure of the overall energy efficiency of the cell. Such an analysis is critical for effective cost control in a chlor-alkali cell system.

B. Thermal Measurement

Temperature measurements are still another means for monitoring overall system performance. In many modern membrane-type chlor-alkali cells, it is found that more or less "optimum" performance is achieved when a steady-state operating temperature in the range of between about 85° to about 100° C. is reached. Higher temperature values may cause undesirable boiling in the cell; lower ones result in reductions in overall efficiency. Since the normal electrical IR losses appear as heat in the cell, the entering brine is kept at a temperature below this value to keep the system in thermal balance. For brine, the input temperature range is normally kept between about 25° and about 70° C. depending on the design of the cell.

For water input, ambient temperature is normally used. At high caustic concentrations, relatively small amonts of water are needed to achieve steady-state conditions and given the other sources of heating and cooling in the system, this has relatively little effect on overall system temperatures. However, as noted above, the final caustic temperature reached is the starting point for determining adequacy of brine temperature control so it must be closely monitored to provide a correct signal for process optimization.

A wide variety of devices are available to measure process stream temperatures. Preferred, in the present system, are resistive temperature device (RTD) sensing elements with platinum wire offering a particularly good combination of thermal factors coupled with excellent chemical resistance to attack from both the brine and caustic solutions.

Each of sensors 77 is individually mounted in a thermowell 78 which in turn is inserted into the particular process stream being monitored. Where necessary, good contact can be maintained by biasing, such as by spring loading, the element against the bottom of the thermowell. Normally, any thermowell compatible with the working environment in which it is used will suffice. However, for fastest response time to temperature changes, relatively short (typically 4" to 6" in length) thermowells made of materials having good thermal conductivity should be used. The exact materials of construction used for the thermowells 78 will depend on the application involved. For brine, anolyte and $Cl_2$ temperature measurement, titanium is preferred. For measurements in water, caustic and $H_2$, 316 stainless steel or nickel alloys are preferred.

In the current system, power to each of the sensors is provided by its associated temperature multiplexer 79 which measures resistance variation as directly as a millivolt change at constant current. In such a system, no external reference is needed once the system is initially calibrated. Techniques for doing this are well known in the instrumentation art.

As shown in FIG. 2, temperatures are recorded at 7 different places in the system identified as sites T-1 through T-7. Temperatures are recorded for the brine inlet (T-1), brine outlet (T-2), water inlet (T-3), caustic outlet (T-4), chlorine outlet (T-5), hydrogen outlet (T-6) and ambient temperature (T-7). By so doing, a complete thermal profile of the system can be readily obtained.

Associated with the brine temperature monitor is temperature controller 80 in brine conduit 51. Should the feedstock be running outside the nominal temperature range, thermal multiplexer 79 is adapted to receive and transmit a signal to activate heating/cooling subsystem 82 to rectify the situation. Where programmable controllers are used, such signals are generated directly therein. Because of the relatively low flow of water into catholyte compartment 44, there is no need to heat $W_{in}$ and therefore no heating/cooling system is provided in water conduit 56.

C. Process Stream Composition a. Brine/Caustic Composition

While composition values for the brine and caustic streams could easily be determined by standard analytical techniques applied to samples taken thereof, such techniques are, of necessity, rather slow and not well suited to the needs of a continuously flowing process. In the present invention, this problem is solved by using known correlations between the densities of these process streams and their compositions as the basis for such an analysis. The analyses are simplified because both streams are relatively pure solutions of the chemicals involved with only minimal amounts of impurities present.

Figure 5:
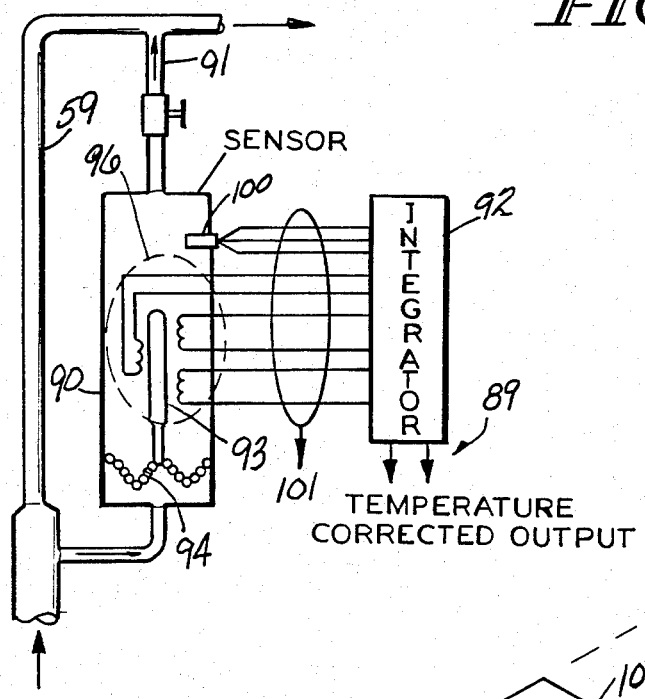
FIG. 5 is a schematic drawing of a typical continuous density monitoring device as used for process streams of the present invention.

A typical example of a densitometer 89 which can be used for this purpose is shown in FIG. 5. This comprises a sensing chamber 90, through which a bypass connected sample stream 91 flows, and a remote mounted integrator 92 which combines electrical and temperature signals received from the sensor. Chamber 90 contains a totally submerged float 93, having an iron core (not shown) therein, held by an attached chain 94 to a fixed reference point. Materials for the float, chain and chamber depend on the application. For caustic, they are generally made of 316 stainless steel; for brine, titanium. Float 93 is ballasted by chain 94 so that at the middle of the stream calibration range it assumes an equilibrium position with the weight of calibrating chain 94 being essentially equally supported by the float and the base of chamber 90. Any change in density causes the float to either rise or fall to a new equilibrium point. As the float so moves, chain links are transferred either to or from the base until a new equilibrium position is reached where the weight of the chain again balances the float buoyancy. Thus, for any given density within the range of the float/chain assembly, the float will assume a definite equilibrium position. These changes of vertical position of the float and its associated internal iron core are sensed by a linear variable differential transformer (LVDT) 96 which sends a low voltage AC signal via cable 101, proportional to said core position, to integrator 92. Temperature compensation is also provided by resistance thermometer 100 located in chamber 90, the output of which is also transmitted by cable 101 to integrator 92 where it is combined with the density signal to produce an integrated temperature corrected millivolt output. As shown in FIG. 2, after A/D conversion, this signal is supplied via multiplexer 102 to ACU 12 for use in determining the brine and caustic feedback signals, FB1 and FB3 of FIG. 3, respectively.

A number of units working on this principal are available. The particular ones chosen will depend on individual need for accuracy, working range and flow rate capability.

Figure 6:
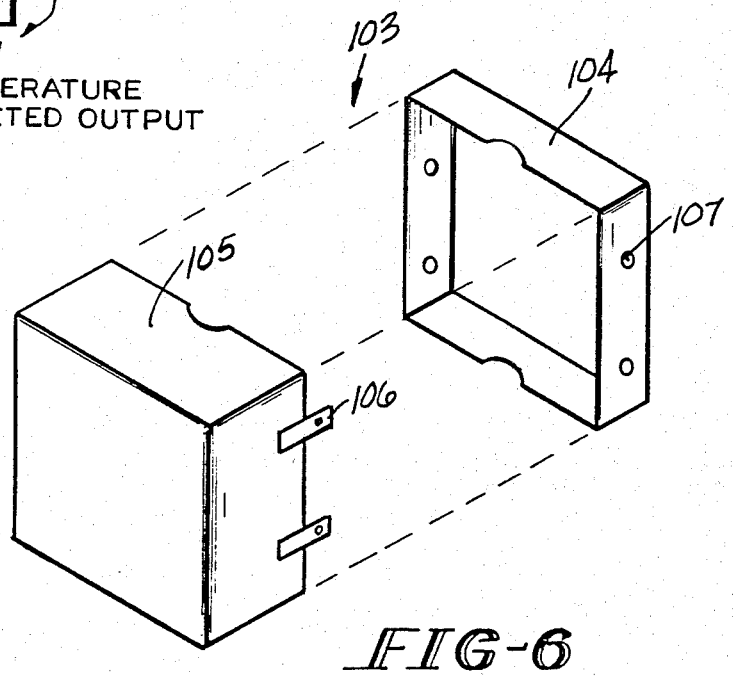
FIG. 6 is a design of an exemplary magnetic shield as used with the monitoring device of FIG. 5.

Due to high magnetic field strengths found in the vicinity of many chlor-alkali cell environments, it is sometimes necessary to shield chamber 90 to prevent incorrect signal voltages from being generated in LVDT 96. One satisfactory design for this, shown in FIG. 6, comprises a carbon steel box 103 which is itself comprised of right and left parts 104 and 105 made from steel plates mated around chamber 90. In the present invention, about ¼" thick plate has been found to provide adequate shielding. Any attachment means can be used as long as the shielding integrity is maintained. As shown, the two parts are held together by tabs 106 on one part which positionally match threaded holes 107 in the other part so that it can be firmly clamped to chamber 90.

b. Chlorine Gas Analysis

While chlorine gas analysis, per se, is not a factor generally considered in controlling the operation of the cell, it does provide a measure of the general state of "health" of the anolyte side of the cell system. As presently configured, three such analyses are performed. All of them can be continuously made either by an in-line device such as a gas chromatographic unit (GCU) 108 or by periodic off-line analysis of individual samples with the data being entered into the data banks of peripheral storage system 16 from console station 14 by the system operator. Techniques to do this are well known.

Unlike the sensors used for factors such as temperature and stream density, which are essentially instantaneous in regard to acquisition and reporting of data, a GCU requires a discrete period of time to acquire and then analyze the samples needed for these analyses. Consequently, it is GCU 108 rather than ACU 12 which controls the reporting. This is done, normally, by GCU 108 setting a "ready" flag with ACU 12 responding according to whatever level of priority is established for such signals. Since, in the present embodiment of this invention, chlorine gas measurements are not primary control factors, no special problems result from such an arrangement. When ready, the data are transmitted to ACU 12 by multiplexer 110.

(1) Oxygen—The electrolysis of water produces oxygen at the anode. When a salt containing brine is electrolyzed, the lower overvoltage of chlorine causes it be be preferentially generated so that in a well maintained cell, there will normally be very little oxygen in the gas stream. Increases in the $O_2$ content can be attributed either to air leakage into the system, degradation of the anode surface, or excessive back migration of hydroxyl ($OH^-$) ions through the membrane. Air leakage is confirmed by $N_2$ measurements; back migration is prevented by proper anolyte pH control. When these factors can be eliminated as causes, anode degradation is confirmed.

(2) Nitrogen—Air leakage is determined by the nitrogen content of the gas. While there is always some amount of air dissolved in the brine and released in the cell, this only provides a low level of $N_2$ in the chlorine stream. Any significant amount above this confirms air leakage in the system.

(3) Carbon dioxide—While the brine stream receives extensive pretreatment to remove inorganic contaminants, it is possible for some quantity of $Na_2CO_3$ to remain in the brine after pretreatment to remove calcium and magnesium. Where operating conditions require an acidic brine, hydrochloric acid is added to the brine in head tank 52 for holding it for some period of time to allow any $CO_2$ generated to separate and be vented off. Where the brine is not so acidified, the normal anolyte pH of about 3 to about 5 will cause $CO_2$ to form. While some $CO_2$ in the chlorine may therefore expected to be normal, excessive amounts may cause undesirable foaming within the anolyte compartment.

Organic contamination may also be present, especially if the brine is derived from non-rock salt sources. If present, in sufficient amounts, such contamination may attack or otherwise degrade the membrane. Also, the harsh chemical, electrical and thermal conditions encountered tend to cause at least some of this contamination to oxidize in anolyte compartment 42 with the resultant appearance of $CO_2$ in the chlorine stream. Consequently, a $CO_2$ measurement can therefore provide an additional means for assuring both input brine quality and the adequacy of brine treatment should such assurance be necessary.

c. Water Content of Hydrogen

Determination of the mositure content of the hydrogen stream is done by temperature measurements and the comments made concerning this measurement in section 6 above apply with equal relevance.

d. Brine pH Measurement

Measurements of pH are a regular control means used with many process streams. However, sensors able to withstand the harsh environment of the spent brine system for any length of time have, in the past, not been readily available. However, one suitable transducer for this purpose is described in U.S. Pat. No. 4,128,468, issued to Bukamier, on Dec. 5, 1978 and which is incorporated herein by reference.

Anolyte pH is a particularly good measure of brine side performance in an operating cell. As long as the pH value stays in the pH range of between about 2 and about 4, consistent operational characteristics are obtained. Higher pH values may be indicative of a problem with excessive backflow of hydroxyl ions from the catholyte chamber through the membrane into the anolyte chamber.

e. Flow Measurement

A variety of devices to monitor flow rates in process streams are currently in use. For this embodiment of the present invention, paddle wheel flow monitor 116 of FIG. 2 are adapted to generate a signal proportional to the flow rate or velocity of fluid in a pipe. In one embodiment of such a device, the paddle wheel contains a plurality of magnets which rotate past a coil to generate an AC current having a frequency proportional to flow. As noted above, such a signal can be used for feedback purposes around control loop Ia comprising water flow controller 118 and valve 120 and in loop IIIa for brine flow controller 122 and brine valve 124.

In another embodiment, the paddle contains only one magnet which rotates past a suitable detector at a rate proportional to flow. This generates a pulsed signal which as noted above can also be used for this purpose. Data from both type of sensors is processed by multiplexer 126 for such use.

This invention may be embodied in other specific forms without departing from the spirit or essential characteristics thereof. The present embodiments are therefore to be considered in all respects as illustrative and not restrictive, the scope of the invention being indicated by the appended claims rather than by the foregoing description and all changes which come within the meaning and range of equivalency of the claims are therefore intended to be embraced therein.

What is claimed is:

1. A method for controlling the operation of a chlor-alkali cell, said cell comprised of anolyte compartment having an anode therein and a catholyte compartment having a cathode therein, said compartments being sealingly separated by a permselective membrane mounted therebetween, said cell receiving process streams comprising an alkali metal halogen salt brine in said anolyte compartment and water in said catholyte compartment, said cell acting under the stimulus of an electric current passing from said anode to said cathode to cause positive ions of said alkali metal to pass through said membrane to form an alkali metal caustic solution and hydrogen in said catholyte compartment and depleted brine and free halogen in said anolyte compartment as product streams eminating therefrom, said cell further comprising sensor means adapted to monitor the parameters comprising temperatures, compositions and flow rates of said process and product streams, control means adapted to control said parameters and a central control unit integrated with said sensor means and said control means, said control method comprising the steps of:

a. determining a value representative of a target product set point for output water loss, said loss being the total of the concentration of water in the alkali metal caustic product output stream, the flow rate of said output stream and the water lost at said cathode by the electrolytic reaction forming free hydrogen gas and hydroxyl ions in said catholyte compartment, said value being identified as $W_{caustic}$;

b. determining a value representative of the mass of water passing from said anolyte compartment to said catholyte compartment during electrolysis as determined by the water transport properties of said membrane, said mass being a composite function of anolyte brine concentration, caustic concentration, cell current and cell temperature and being identified as $W_{membrane}$;

c. determining a value representative of the mass of water leaving said catholyte compartment in said hydrogen product stream, said mass being the product of the humidity and flow rate of said hydrogen product stream and being identified as $W_{H2}$;

d. utilizing the values determined in steps a. to c. to calculate a target value representative of the required mass flow rate for the water input process stream, said stream being identified as $W_{in}$ as calculated by the equation:

$$W_{in}=W_{caustic}+W_{H2}-W_{membrane};$$

e. measuring the actual mass flow rate of water entering the system;

f. comparing said calculated target water mass flow rate with said actual flow rate to generate an error signal representative of the difference between the two;

g. when the magnitude of said error signal is outside the predetermined tolerance band therefore recomputing a new value of $W_{membrane}$, said recomputed value being based on said error signal magnitude, said recomputed value being used to generate a control signal to adjust said actual water mass flow rate so as to reduce said error signal magnitude;

h. transporting said control signal to a flow rate controller for said water input stream;

i. adjusting the flow rate of said water input stream with said flow rate controller; and j. repeating steps c. to i.

2. The method of claim 1 further comprising the steps of:

a. determining a value representative of the anolyte brine output water loss, said loss being the product of the concentration of water in the anolyte brine output stream and the flow rate of said output stream and being identified as $W_{anolyte}$;

b. determining a value representative of the mass of water leaving said anolyte compartment in said halogen output stream, said mass being the product of the concentration of water in said halogen product stream and its flow rate and being identified as $W_{Cl2}$;

c. determining the value representative of the mass of water passing from said anolyte compartment to said catholyte compartment under the stimulus of said current as determined by water transport properties of said membrane, said mass being a composite function of anolyte brine concentration, caustic concentration, cell current and cell temperature and being identified as $W'_{membrane}$;

d. utilizing the values determined in steps a. to c. to calculate a target value representative of a mass flow rate for a brine input process stream, said stream acting to provide a source of alkali metal for the caustic product formed in said catholyte compartment and a source of halide ions for the electrolytic process, said value being identified as $W_{brine}$ as calculated by the equation:

$$W_{brine}=W_{anolyte}+W_{Cl2}+W'_{membrane};$$

e. measuring the actual mass flow of brine entering the system;

f. comparing said calculated target brine mass flow rate with said actual flow rate to generate an error signal representative of the difference between the two;

g. when the magnitude of said error signal is outside the predetermined tolerance band therefore recomputing a new value of $W'_{membrane}$, said recomputed value being based on said error signal magnitude, said recomputed value being used to generate a control signal to adjust said actual brine mass flow rate so as to reduce said error signal magnitude;

h. transporting said control signal to a flow rate controller for said brine input stream;

i. adjusting the flow rate of said brine input stream with said flow rate controller in accordance with said error signal; and j. returning to step a.

3. The method of claim 2 further comprising the steps of:

a. determining a value representative of a target product tolerance band for the mass of alkali metal ion entering in the incoming brine product stream, said mass being identified as $S_{in}$;

b. determining a value representative of the mass of alkali metal ion leaving said anolyte compartment in said anolyte product stream, said mass being identified as $S_{anolyte}$;

c. determining a value representative of the mass of alkali metal ion passing through said membrane so as to act as a basis for the alkali metal content of the caustic product stream from said catholyte compartment, said mass being identified as $S_{membrane}$;

d. utilizing the values determined in steps b. and c., calculate a value representative of a target mass flow rate for alkali metal ions passing through said cell as calculated by the equation:

$$S_{in}=S_{anolyte}+S_{membrane};$$

e. measuring the actual alkali metal mass flow rate as determined from the anolyte and catholyte flows of the system;

f. comparing said actual and target values to generate an error signal representative of the difference between the two and where the magnitude of said error signal is outside the predetermined tolerance band therefore;

g. generating a control signal based on the magnitude of said difference and transmitting said control signal to a flow rate controller in the brine input process stream, said control signal acting to change as required the brine flow rate into said anolyte compartment to bring said alkali metal mass flow into equilibrium, said control signal further acting to actuate an alarm signal so that the concentration of alkali metal halide in said brine process stream may be corrected; and h. returning system status to step a. above.

4. The process of claim 1 wherein said alkali metal is sodium and said halide is chlorine.

5. The method of claim 1 further comprising:

a. entering into said central automatic control unit signals representative of the impurities, allowable limits for said chlorine product stream;

b. periodically, under the direction of said central automatic control unit, causing a sample to be taken from said chlorine process stream and analyzed for the values of said impurities;

c. where at least one of said analytical values exceeds allowable limits therefore producing an appropriate alarm signal indicative of said excessive value; and d. returning system status to step b. above.

6. The method of claim 1 further comprising:

a. entering into said central automatic control unit signals representative of a target tolerance band for the pH range for said brine input process stream;

b. periodically, under the direction of said central automatic control unit, acquiring a signal relating to the pH of said brine input process stream;

c. where said pH value is outside of said target tolerance band, transmitting a control signal to a flow rate controller in an acid input line for said cell, said signal causing said flow rate controller to change the amount of acid used to adjust the pH of said brine so as to bring said pH to be within said target tolerance band; and d. returning system status to step b. above.

7. The method of claim 1 further comprising:

a. entering into said central automatic control unit a signal representative of a target tolerance band for the temperature of said brine input process stream;

b. periodically, under the direction of said central automatic control unit, causing said sensors to transmit a signal relating to the temperature of said brine input process stream;

c. where the value of said temperature is outside said target tolerance band, transmitting a control signal to a controller means for a heating/cooling system located within said brine input process stream located within said brine so as to change the temperature of the brine as required; and d. returning system status to step b. above.

8. The method of claims 1 or 7 wherein said target tolerance band values are manually entered into said central automatic control unit.

* * * * *